United States Patent [19]

Wallace et al.

[11] 4,347,902

[45] Sep. 7, 1982

[54] ROTARY IMPACT WRENCH CLUTCH

[75] Inventors: William K. Wallace, Barneveld; David A. Giardino, Deerfield, both of N.Y.

[73] Assignee: Chicago Pneumatic Tool Company, New York, N.Y.

[21] Appl. No.: 104,848

[22] Filed: Dec. 18, 1979

[51] Int. Cl.[3] ..... B25B 19/00

[52] U.S. Cl. ..... 173/93.5

[58] Field of Search ..... 173/93, 93.5; 81/52.3, 81/463–465

[56] References Cited

U.S. PATENT DOCUMENTS

| | | | |
|---|---|---|---|
| 3,179,219 | 4/1965 | Karden | 173/93.5 |
| 3,414,065 | 12/1968 | Falter | 173/93.5 |
| 3,533,479 | 10/1970 | Madsen | 173/93.5 |
| 3,552,499 | 1/1971 | Maurer | 173/93.5 X |
| 3,734,205 | 5/1973 | Maurer | 173/93.5 |

FOREIGN PATENT DOCUMENTS

| | | | |
|---|---|---|---|
| 469727 | 11/1950 | Canada | 173/93.5 |

*Primary Examiner*—Werner H. Schroeder
*Assistant Examiner*—Andrew M. Falik
*Attorney, Agent, or Firm*—Stephen J. Rudy

[57] ABSTRACT

This invention relates to an impact wrench clutch mechanism having a single roller element extending longitudinally between a motor driven coupling and an anvil. A hammer enclosing the roller member, has a single longitudinal pocket, engaged by the roller element for transmission of rotary movement to the hammer. The anvil has cam means arranged to activate the roller element whereby anvil rotation is accomplished with or without impacting, depending upon work load resistance applied to the anvil. The cam means are arranged to provide high rate of acceleration to the hammer whereby impacting values are unexpectedly high.

6 Claims, 7 Drawing Figures

ROTARY IMPACT WRENCH CLUTCH

BACKGROUND OF INVENTION

This invention relates to an improvement whereby an impact tool of extreme simplicity is provided, characterized by utilization of a minimal number of operative parts, with rugged construction and reliable operation in either direction of rotation.

The invention distinguishes over the impact clutch mechanism disclosed in U.S. Pat. No. 3,552,499, by the absence of a second roller element and elimination of a cage member, both being necessary elements in the structural arrangement of the cited patent.

DESCRIPTION OF PREFERRED EMBODIMENT

Figure 1:
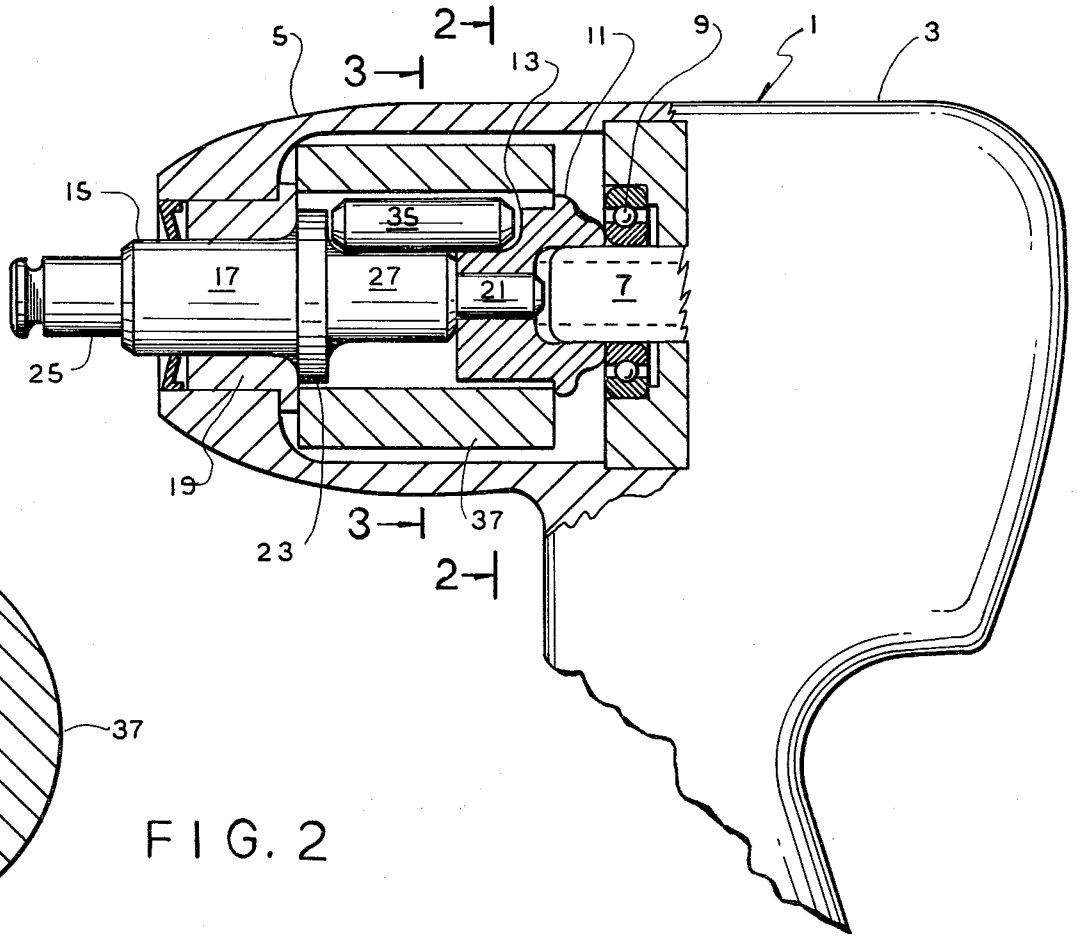
FIG. 1 is an elevation view, in partial section, of an impact wrench embodying the principles of the invention.

In FIG. 1, numeral 1 identifies a pneumatic hand-held tool, a portion of the handle not being illustrated, which tool includes a motor housing portion 3, and a clutch housing portion 5. The motor portion encloses a pneumatic motor of the radial vane type well known in the art, having a rotor shaft 7 rotatably mounted in bearing means 9 supported in the housing.

The clutch mechanism of the invention includes a coupling member 11, having a spline connection with the drive rotor shaft 7, and formed with a semi-circular groove 13. A cylindrical anvil member 15, arranged in the clutch housing portion, has a bearing surface 17 at the forward end for support in a bushing 19 mounted in the housing portion, and a reduced diameter portion 21 at the rear end, which is mounted in the coupling member and rotatable relative to the coupling member 11. A flange 23 formed on the anvil member is positioned to abut the bushing 19 to restrict forward movement of the anvil member. A socket portion 25 is formed on the forward extremity of the anvil member for receipt of a work engaging socket, not shown.

The anvil member 15 is provided with a cam portion 27 on which is formed symmetrical and diametrically opposed cam projections 29 and 31, and a lug 33 arranged to receive impact blows during tool operation.

Figure 2:
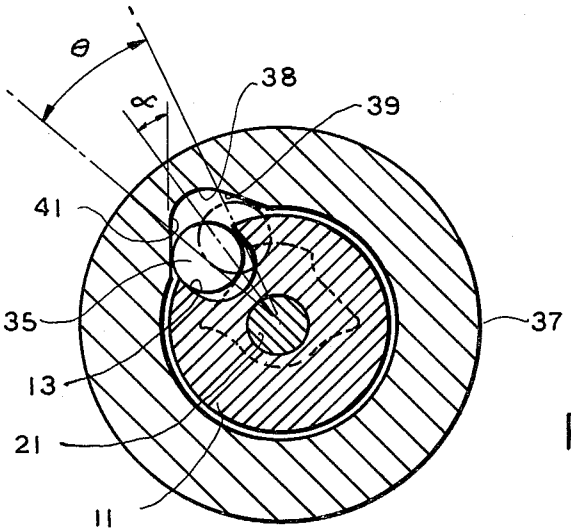
FIG. 2 is a section view as seen from line 2—2 in FIG. 1.
Figure 4:
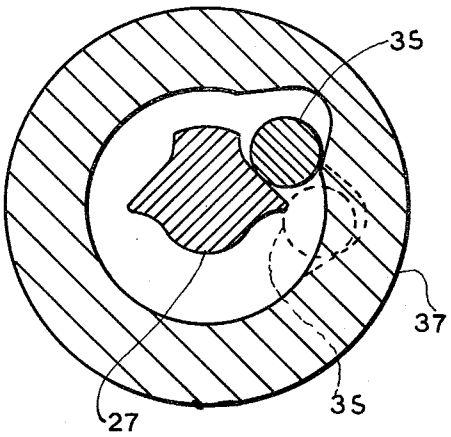
FIGS. 3–7 are section views as seen from line 3—3 in FIG. 1, and illustrating the relative position of movable parts during certain phases of clutch operation.

A rotatable cylindrical pin, or roller 35 is arranged to extend adjacent to and in contact with the cam portion 27, with the rear-end of the pin positioned in the coupling groove 13. Surrounding the pin is a cylindrical hammer element 37, having a longitudinal slot 38 formed with symmetrical cam surfaces 39 and 41. The arrangement of hammer cam surfaces 39 and 41 allow relative movement between the hammer and the anvil, as limited by contact with the pin, an arcuate distance $\theta$, as seen in FIG. 2. Such free wheeling motion of the hammer relative to the anvil allows for acceleration of the hammer to a rotational speed greater than that of the rotor, whereby kinetic energy developed in the hammer will be added to that of the other rotating parts for impacting on the anvil. An arcuate distance $\theta$, in the range of 35° to 45°, optimizes impacting action over the full range of tool operation upon the work piece. An arcuate distance greater than the optimum range specified would produce inertia loss during work run-up operation, because of the time required for the hammer to catch up with the pin, while an arcuate distance less than the optimum range would not allow maximization of hammer inertia because of the short time period of free wheeling motion of the hammer relative to the anvil.

The hammer cam surfaces 39 and 41 are arranged at an angle of $\alpha$, having a range of 30° to 40°, a range which provides desired acceleration of the hammer when the pin is moved radially outward by action of anvil cam surfaces 43 or 45, depending upon rotational direction of the pin.

Cam projections 29 and 31 are formed with double sided cam surfaces, of which 43 and 45 respectfully, serve to propel the pin 35 radially in the direction of the longitudinal slot of the hammer element during tool operation. Cam sides 47 and 49, arranged on the opposite sides of the cam surfaces 43 and 45 respectively, function as pin placement controls, rather than pin ejection means, as with cam surfaces 43 and 45. It is to be noted that the slope of each cam surface 43 and 45 is gradual so that pin radial ejection movement is accomplished smoothly with ejection speed increasing to maximum value as the crest of the cam is approached.

It will be seen in FIG. 1 that the pin is enclosed beneath the hammer by abutment with the anvil flange 23 and the end of longitudinal groove 13 formed in the coupling member 11.

OPERATION OF THE CLUTCH MECHANISM

Figure 3:
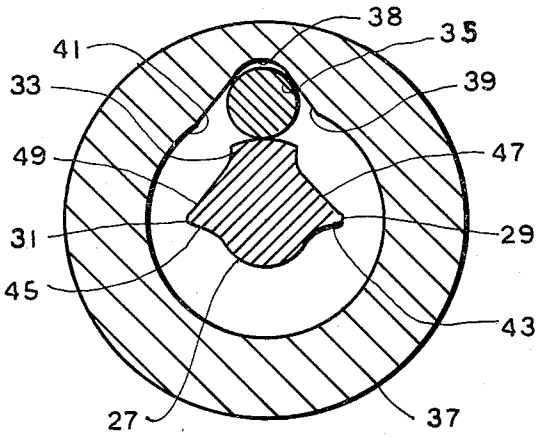

At start of tool operation the movable parts may be in various relative positions, however, considering FIGS. 2 and 3, it will be seen that with activation of the tool motor for a fastener setting operation, the coupling member 11 and pin 35 will be rotated in a clockwise direction. Pin 35 will be moved into contact with hammer cam surface 39, and will engage anvil cam surface 47 to cause rotation of the anvil 15.

Figure 5:
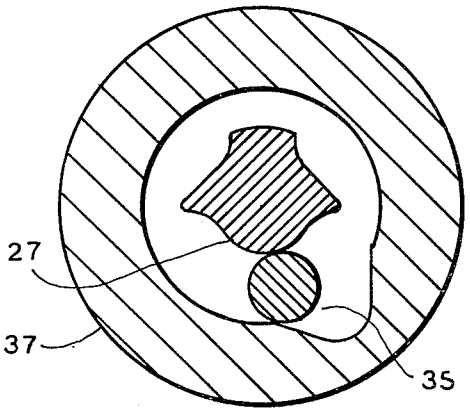

As resistance to rotation builds up on the fastener, the pin 35 will be forced around the cam projection 29, as seen in FIG. 5, and brought into contact with anvil cam surface 45, to continue rotation of the anvil. Once fastener resistance attains a predetermined value, the pin will be forced around cam projection 31, and continue the rotational sequence just described.

Figure 7:
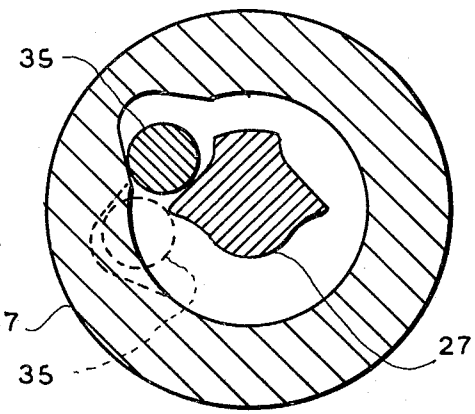
Figure 6:
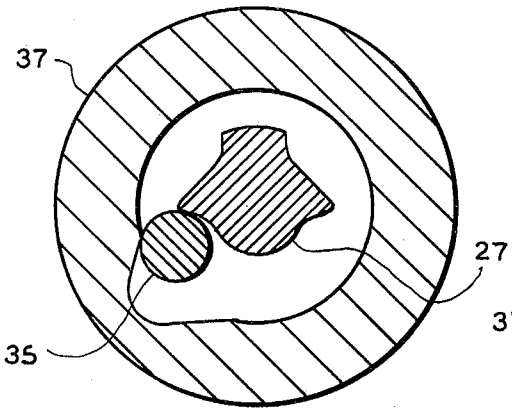

As rotational speed increases, the pin is brought sharply into engagement with the anvil cam 45, and the pin will be rapidly moved radially against the hammer cam 39, to cause acceleration of the hammer through an arcuate distance $\theta$ resulting in rotary speed of the hammer higher than that of the rotor and the coupling. As seen in FIG. 7, the hammer cam surface 41 will engage the pin and force it into contact with surface of the lug 33, and the stored energy of all the rotating parts will result in an impact blow upon the anvil to cause rotation of the work piece.

Impact reaction will momentarily stop, or slow down rotation of the hammer relative to the anvil, resulting in movement of the pin around the lug 33 and allowing repeat of the impacting cycle described.

Since the anvil cam surfaces and those of the hammer are symmetrical, reverse rotation of the anvil during tool operation for driving a fastener in a counter-clockwise direction, is accomplished in the same manner as described above.

It will be seen from the foregoing disclosure that the tool of the invention accomplishes the desired objective of improved tool performance with a simple and durable structural design, using fewer parts than employed in known prior art impact wrench clutches.

What is claimed is:

1. In an impact tool have a housing enclosing a motor means and an output shaft for rotation of a work piece, a clutch mechanism including an anvil member, a hammer surrounding the anvil member, a pin positioned between the anvil member and the hammer, and a coupling member for connecting the pin with the motor means wherein the coupling member is interengagedly connected to the output shaft at a first end, said coupling member having a semi-circular groove at a second end for receipt of one end of the pin, said anvil being formed with diametrically opposed double-sided cam means which serve to move the pin in a longitudinal slot of the hammer, said anvil having a lug with surfaces arranged for receipt of an impact blow from the hammer by way of the pin.

2. In an impact wrench according to claim 1, wherein the radial spacing between the anvil and hammer is less than the diameter of the pin whereby the pin will continuously project into the longitudinal slot of the hammer.

3. In an impact wrench according to claim 2, wherein said anvil cam means are arranged to rapidly direct movement of the pin into the longitudinal slot of the hammer resulting in momentary acceleration of the hammer to a rotational speed greater than that of the rotor.

4. In an impact wrench according to claim 3, wherein said longitudinal slot of the hammer has symmetrical cam surfaces one of which is engaged by the pin while the pin is being rotationally moved toward engagement with a cam means of the anvil, the other which engages the pin upon hammer acceleration to drive the pin into engagement with the lug of the anvil.

5. In an impact tool having a housing enclosing a motor means and an output shaft for rotation of a work piece, a clutch mechanism including an anvil member, a hammer surrounding the anvil member, a pin positioned between the anvil member and the hammer, and a coupling member for connecting the pin with the motor means, said anvil being formed with diametrically opposed double-sided cam means which serve to move the pin in a longitudinal slot of the hammer, said anvil having a lug with surfaces arranged for receipt of an impact blow from the hammer by way of the pin, the radial spacing between the anvil and hammer being less than the diameter of the pin whereby the pin will continuously project into the longitudinal slot of the hammer, said anvil cam means being arranged to rapidly direct movement of the pin into the longitudinal slot of the hammer resulting in momentary acceleration of the hammer to a rotational speed greater than that of the rotor, said longitudinal slot of the hammer having symmetrical cam surfaces one of which is engaged by the pin while the pin is being rotationally moved toward engagement with a cam means of the anvil, the other which engages the pin upon hammer acceleration to drive the pin into engagement with the lug of the anvil, the cam surfaces of the longitudinal slot allowing rotation of the hammer relative to the anvil an arcuate distance in the range of 40° to 50° as limited by contact between said cam surfaces and the pin.

6. In an impact wrench according to claim 5, wherein the slope of the longitudinal slot cam surfaces are each arranged at an angle relative to a radial centerline which angle is in a range of 30° to 40°.

* * * * *